United States Patent [19]

Doorley et al.

[11] Patent Number: 4,556,127

[45] Date of Patent: Dec. 3, 1985

[54] RAILWAY TRACK LUBRICATOR

[75] Inventors: Richard B. Doorley, Pittsburgh; Paul J. Henninger, Allison Park; Chester F. Klages, Jr., Evans City; Jerrold K. Shetter, Saxonburg, all of Pa.

[73] Assignee: Trak-Tech, Inc., Zelienople, Pa.

[21] Appl. No.: 542,755

[22] Filed: Oct. 17, 1983

[51] Int. Cl.[4] ..... B61K 3/00

[52] U.S. Cl. ..... 184/3.1; 74/54; 74/142; 92/13.41; 417/319

[58] Field of Search ..... 184/3.1, 15.2, 15.3; 198/500; 104/279; 74/141.5, 142, 568 R, 54 R; 92/13.4, 13.41; 417/229, 319

[56] References Cited

U.S. PATENT DOCUMENTS

| | | | |
|---|---|---|---|
| 2,223,714 | 12/1940 | Bates et al. | 184/3.1 |
| 2,285,082 | 6/1942 | Bolt | 417/229 |
| 2,355,241 | 8/1944 | Rodman et al. | 184/3.1 |
| 2,401,303 | 6/1946 | Huber | 184/3.1 |
| 2,428,171 | 9/1947 | Mennie | 184/3.1 |
| 2,448,670 | 9/1948 | Heidenthal | 184/3.1 |
| 2,486,600 | 11/1949 | Huber et al. | 184/3.1 |
| 2,490,334 | 12/1949 | Bates | 184/3.1 |
| 2,498,519 | 2/1950 | Bates | 184/3.1 |
| 2,643,738 | 6/1953 | Magnus | 184/3.1 |
| 2,775,204 | 12/1956 | Batten et al. | 417/319 |
| 2,814,422 | 11/1957 | Mercier | 184/3.1 X |
| 2,884,093 | 4/1959 | Stewart | 184/3.1 |
| 2,887,179 | 5/1959 | Steele et al. | 184/3.1 |
| 2,907,410 | 10/1959 | Stokes | 184/3.1 |
| 2,929,466 | 5/1960 | McWilliams | 184/3.1 |
| 2,995,209 | 8/1961 | Magnus | 184/3.1 |
| 3,015,370 | 1/1962 | McWilliams | 184/3.1 |
| 3,059,724 | 10/1962 | Soule, Jr. | 184/3.1 |
| 3,163,257 | 12/1964 | McWilliams | 184/3.1 |

*Primary Examiner*—Leonard E. Smith
*Attorney, Agent, or Firm*—Stanley J. Price, Jr.

[57] ABSTRACT

A ramp lever is adjustably supported by a frame secured to the rail of a railway track. The lever has a shaft portion and a car wheel striking portion that extends upwardly from the shaft portion. The ramp lever is rotatably supported by the frame for movement between a raised position and a depressed position. The shaft portion of the ramp lever is connected through an indexing assembly to a drive shaft. A torsion spring extends in surrounding relation from the shaft portion to the indexing assembly. After the car wheel has passed over the ramp lever and depressed the lever, the torsion spring returns the ramp lever to the initial raised position. During the return stroke of the ramp lever to the raised position, the indexing assembly transmits rotation from the ramp lever shaft portion to the drive shaft. The drive shaft is disconnected from the ramp lever as the car wheel depresses the ramp lever to isolate the drive shaft from the shock forces transmitted by the car wheel. Rotation of the drive shaft is transmitted to a roller disc carrying a plurality of rollers adjustably, radially positioned on the roller disc. An anti-regression clutch on the drive shaft prevents backward movement of the drive shaft as the ramp lever is depressed. A lever is pivotally mounted adjacent to the roller disc, and a lubricant pump is operatively connected to the lever. As the roller disc rotates, the rollers move into and out of contact with a cam surface of the lever to intermittently downwardly move the lever and actuate the pump to convey lubricant through a hose to the flange of the rail.

16 Claims, 5 Drawing Figures

IV
IV

RAILWAY TRACK LUBRICATOR

BACKGROUND OF THE INVENTION

1. Field of the Invention

This invention relates to a lubricator for the rails of a railway track and, more particularly, to a device for actuating a pump to supply lubricant to the railway track.

2. Description of the Prior Art

Devices for supplying lubricant to the gauge side of railway tracks by the wheels of passing cars actuating a lubricator pump are well known in the art. The known lubricators utilize a ramp lever which is connected by a drive assembly to a pump mechanism that is provided with a conduit that conveys lubricant to the gauge side of the track. The lubricator pump and supply reservoir are set in the ground alongside the track. Preferably lubricators are positioned to supply lubricant to selected sections of the railway, for example at curves, to lubricate a curved section of the railway to reduce the noise and wear of the rail and wheel flange.

The ramp lever operated drive assembly of a railway lubricator is subjected to explosive-like shocks caused by the sudden impact of a car wheel against the ramp lever. For example, the interval for depressing the ramp lever and discharging the lubricant is merely 0.005 second for a train speed of 35 m.p.h. A conventional drive assembly includes a number of components, such as a solid metal drive shaft, universal joints, a pump shaft, and a pump lever or plunger, which create inertia resisting movement of the ramp lever. Consequently, rapid wear and breakage of these components is encountered in response to the impact forces transmitted to the components upon depression of the ramp lever. This generates hydraulic shock in the supply hose to the railway and requires the use of a relief valve to prevent bursting the hose and distributor gaskets. The momentum of the moving components is transmitted to the lubricator pump and actuates the pump to "over-stroke". U.S. Pat. No. 2,490,334 discloses an actuator for rail lubricating pumps in which intermittent rotation of a pump-drive shaft is initiated by relative movement between the rail and the rail support. A lever arm is actuated to generate a rocking motion which is transmitted by a ratcheting one-way clutch to the intermittently driven unidirectional pump-drive shaft. An indexing clutch converts rotary oscillation shaft motion to intermittent unidirectional rotation.

U.S. Pat. No. 2,498,519 is an improvement over the above-discussed patent and discloses movement of a ratcheting mechanism from within a rail mounted housing to the lubricant tank. A spring rocks with the ramp lever in one direction with a ratchet by which the rocking motion of the lever is transmitted to the pump shaft. The spring and the ratchet are located remote from the rail so that they act to take up any lost motion which may develop in the relatively long line of shafting that includes telescoped shaft sections and universal joints. With this arrangement, the amount of operation of the pump for each rocking movement of the lever remains constant despite any lost motion which may develop due to wear or other causes between the elements connecting the lever with the pump.

U.S. Pat. No. 2,643,738 discloses an indexing drive which is driven through a telescoped flexible drive shaft. A plunger is depressed by the car wheels and operates through a clutch mechanism to drive unidirectionally the flexible shaft that extends to a lubricant tank set in the ground alongside the track. An outer race of the drive clutch applies torque to the drive shaft to drive the shaft unidirectionally while a shaft of a check clutch applies torque to an outer race to prevent retrograde movement of the shaft. A torsion spring surrounds the hub of the clutch housing and exerts a biasing force to hold a roller against a cam surface provided on a lug which is secured to a plunger. The plunger is pushed down by the car wheels causing the cam roller to travel on the cam surface to generate oscillating movement of a drive arm and the unidirectional movement of the drive shaft which drives the lubricant pumps. In U.S. Pat. No. 2,995,209, the indexing mechanism is moved from a rail mounted position to an in-box mounting.

The principal disadvantage of the known types of rail lubricators is the actuation of the lubricant pump upon the downward movement of the ramp lever or plunger as the car wheel passes over the ramp lever or plunger and the use of in-tank rotary pumps with limited adjustability of displacement. Thus, the lubricator is actuated on the downward stroke of the ramp lever. This results in the adverse affects of shock to the drive train, overstroking of the pump, and excessive pressure in the supply hose. The rate of downward movement of the ramp lever is determined by the speed of the car wheels; therefore, frequently either too much or an insufficient amount of lubricant is supplied to the rail. Thus, the speed of the car wheel over the ramp lever, in most cases, determines the amount of lubricant fed to the distributing nozzle. If a car is traveling slowly, a relatively small amount of lubricant is supplied to the rail and correspondingly, if the car is traveling fast, the lubricator is rapidly actuated and a greater amount of lubricant is supplied.

Therefore, there is a need in railway track lubricators for a pump actuator that is operable to uniformly distribute lubricant to the rail regardless of the speed of the car, and is protected from the affects of the shock transmitted by the moving car wheel.

SUMMARY OF THE INVENTION

In accordance with the present invention, there is provided a lubricator for the rails of railway track that includes a frame supported on a rail of the track. A ramp lever has a shaft portion and a wheel striking portion extending upwardly from the shaft portion. The ramp lever is movable between a raised position and a depressed position. The shaft portion is rotatably connected at one end to the frame. A drive shaft has a first end portion and a second end portion. Indexing means connects the drive shaft first end portion to the other end of the ramp lever shaft portion to transmit rotation in only one direction to the drive shaft. Torsion means is positioned around the ramp lever shaft portion and extends between the indexing means and the ramp lever shaft portion for returning the ramp lever to a raised position from a depressed position. The indexing means is rotatable in a first direction upon downward movement of the ramp lever and rotatable in a second direction upon upward movement of the ramp lever. The torsion means actuates upward movement of the ramp lever and transmission of rotation by the indexing means to the drive shaft. A roller assembly includes a shaft nonrotatably connected to a disc. The roller assembly shaft is drivingly connected to the drive shaft. A lever is pivotally mounted adjacent to the disc. Pump means is connected to the lever for conveying lubricant to the surface of the rail in response to movement of the lever. Follower means are carried by the disc and are movable into and out of engagement with the lever for actuating pivotal movement of the lever as the drive shaft rotates to supply lubricant to the surface of the rail.

Accordingly, the principal object of the present invention is to provide a railway lubricator that actuates a pump to supply measured amounts of lubricant to the rail regardless of the speed of the car wheels on the rail where the shock forces transmitted to the lubricator are substantially negligible.

Another object of the present invention is to provide a railway track lubricator that precisely supplies lubricant to the track in response to cushioned movement of a ramp lever during the return stroke of the lever from a depressed position to a raised position after the car wheel has passed the ramp lever.

A further object of the present invention is to provide a railway lubricator that is protected from the high impact loads, generated when a car wheel passes over the ramp lever, by disconnecting the drive to the lubricator until after the car wheel has passed the ramp lever.

An additional object of the present invention is to provide a railway lubricator which is adjustable to provide precise control of the amount of lubricant dispensed to the railway regardless of the speed of the car wheels on the railway.

Another object of the present invention is to provide a railway lubricator actuating device that includes an indexing assembly connecting a ramp lever through a drive shaft to a pump in which the indexing assembly disconnects the ramp lever from the drive shaft on a downward movement of the lever and connects the ramp lever to the drive shaft after the car wheel has left the ramp lever so that the drive shaft is isolated from the impact forces applied by the moving car wheels to the ramp lever.

These and other objects of the present invention will be more completely disclosed and described in the following specification, the accompanying drawings and the appended claims.

DESCRIPTION OF THE PREFERRED EMBODIMENTS

Figure 1:
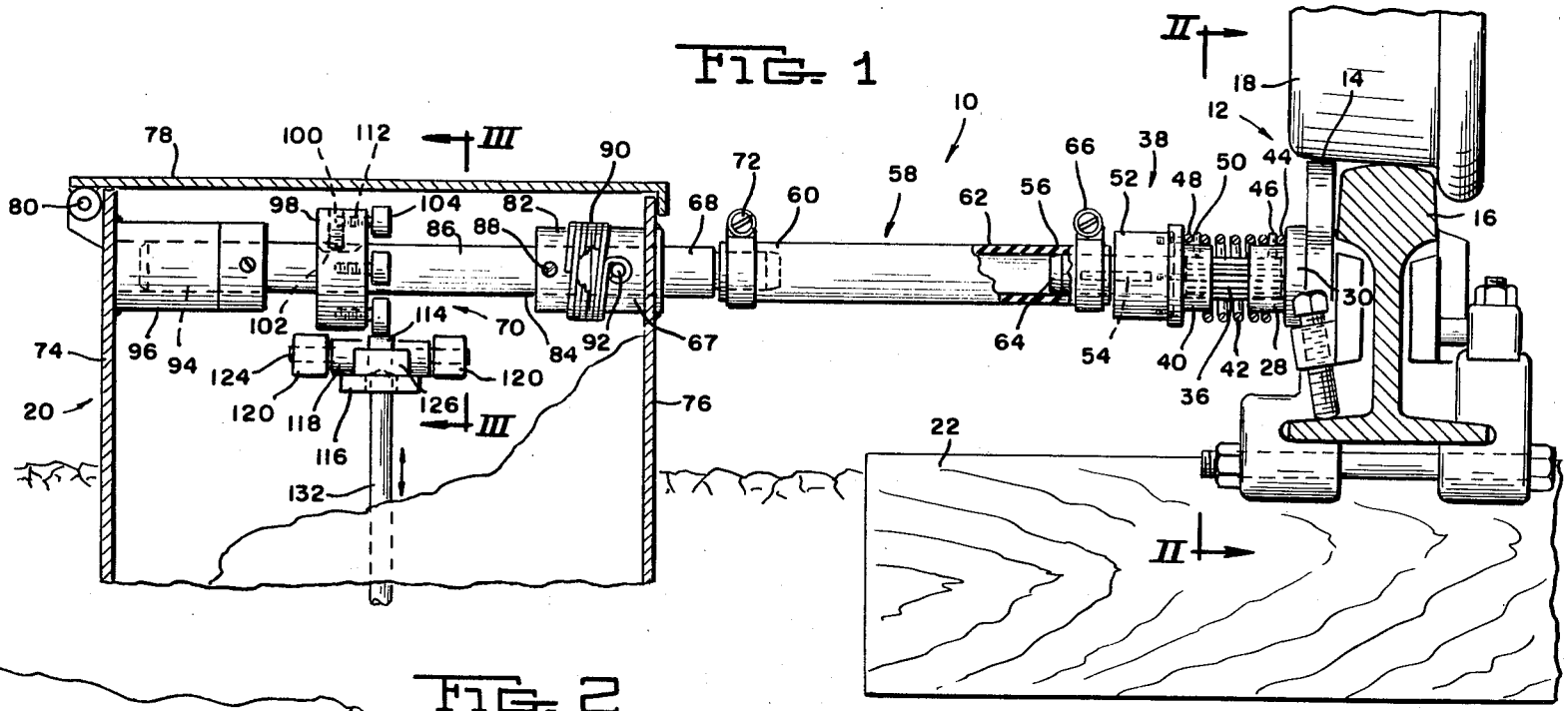
FIG. 1 is an enlarged fragmentary elevational view, partially in section, of a railway lubricator, illustrating a ramp lever connected by an indexing assembly to a flexible shaft connected to a rod of a lubricator pump.
Figure 2:
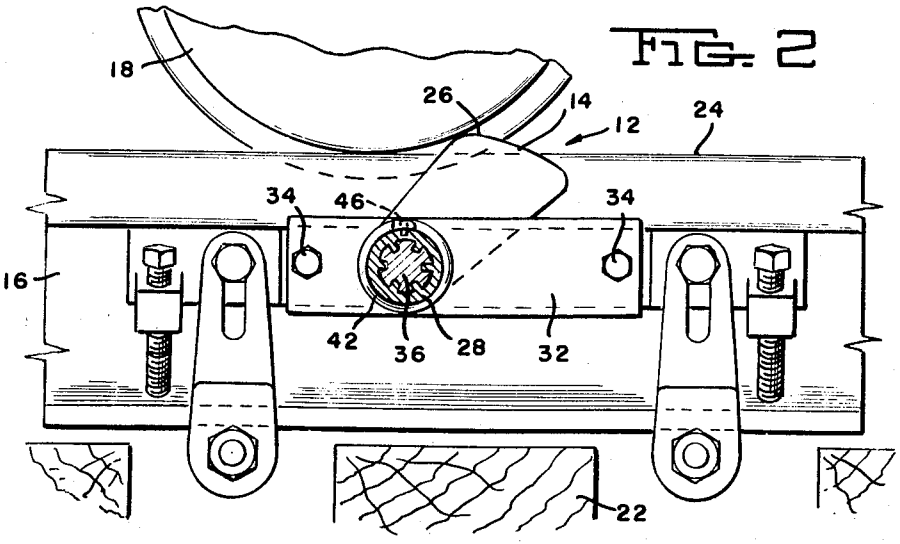
FIG. 2 is a view in side elevation taken along line II—II of FIG. 1, illustrating the ramp lever pivotally connected to the rail to initiate actuation of the lubricator after a car wheel has passed over the ramp lever and during the return stroke of the lever to the initial raised position.
Figure 3:
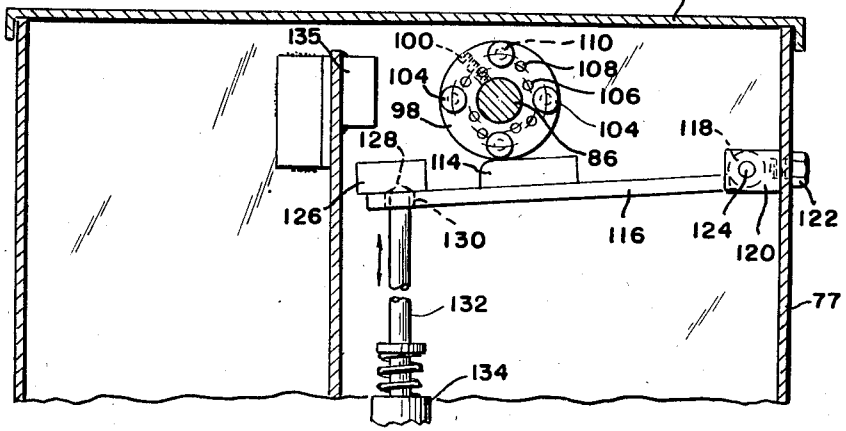
FIG. 3 is a sectional view taken along line III—III of FIG. 1, illustrating a roller disc operable to downwardly depress the pump rod upon rotation of a drive shaft initiated upon upward movement of the ramp lever.

Referring to the drawings, and particularly to FIGS. 1–3, there is illustrated a railway lubricator generally designated by the numeral 10 that includes a ramp lever assembly generally designated by the numeral 12 having a lever arm 14 initially positioned to project above the surface of a railway track 16 as shown in FIG. 2. A car wheel 18 running on the railway track 16 downwardly depresses the lever arm 14 as shown in FIG. 1. The lever arm 14 moves upwardly to the initially raised position after the car wheel 18 has passed the ramp lever assembly 12. A lubricant pump (not shown) is positioned in a housing 20 which is set in the ground adjacent the tie 22 which supports the railway track 16. The lubricant pump is actuated upon upward movement of the ramp lever arm 14 to discharge lubricant from a reservoir or tank contained in the housing 20 through a supply line (not shown) to the gauge side 24 of the flanges of the railway track 16. The construction of the lubricant tank and pump is well known in the art, as well as the supply line which conveys the lubricant from the pump to the track flange, and will not be discussed herein in detail.

The ramp lever arm 14 includes a wheel striking portion 26 and a shaft portion 28. The shaft portion 28 is rotatably journaled at one end in a journal housing 30 of a supporting frame 32. The supporting frame 32 is adjustably connected by fasteners 34 to the railway track 16. The shaft portion 28 has an outwardly extending splined portion 36 that is connected to an indexing assembly generally designated by the numeral 38. The indexing assembly 38 includes a one-way indexing clutch 40. The indexing assembly 38 has an internally splined portion adapted to drivingly receive the shaft splined portion 36.

A torsion spring 42 extends from the journal housing 30 to the indexing assembly 38. A first end 44 of the torsion spring 42 engages a lug 46 extending outwardly from the journal housing 30. A second end portion 48 of the torsion spring 42 engages a lug 50 extending outwardly from the indexing assembly 38. With this arrangement, the ramp lever arm 14 is normally biased in an upward position so that the wheel striking portion 26 extends above the railway track 16. The wheels of a passing car engage the wheel striking portion 26 to downwardly depress the ramp lever arm 14.

The clutch 40 is connected to transmit rotation in only one direction to a drive adapter 52 that is drivingly connected by a key 54 to a first end 56 of a drive shaft generally designated by the numeral 58. In another embodiment, not shown, the adapter 52 can be internally splined to receive a splined end of the drive shaft 58. The drive shaft 58 includes a second or opposite end portion 60. The drive shaft 58, illustrated in FIG. 1, includes a flexible member, such as a rubber hose 62, adapted to receive at a first end 56 a shaft 64 that is drivingly connected to the drive adapter 52 by the key 54. The shaft 64 extends into the rubber hose 62 and is nonrotatably secured thereto by a conventional hose clamp 66. The rubber hose 62 extends to the second end portion 60. A shaft 68 of a roller assembly generally designated by the numeral 70 extends into the end portion 60 of the rubber hose 62. A second conventional hose clamp 72 drivingly connects the rubber hose 62 to the shaft 68.

The roller assembly 70 is positioned in the lubricant tank housing 20 which includes upwardly extending side walls 74, 75, 76 and 77 shown in FIGS. 2 and 3. A cover 78 is pivotally connected at pivot point 80 to the side wall 74 to provide access into the housing 20. The roller assembly shaft 68 is rotatably supported in a journal 67 secured to the housing side wall 76 and extends through the side wall 76. Within the housing 20, the shaft 68 extends through a sleeve 82 that is nonrotatably connected by a set screw 88 to an end portion 84 of a roller disc shaft 86 which is an extension of the shaft 68. One end of a wire-wrap spring clutch 90, also known as a back stop spring, surrounds sleeve 82 with a slight friction interference and is anchored at a second end on journal 67 by engaging a lug 92. As shaft sleeve 82 rotates with shaft 86, driven by torsion spring 36, the friction between sleeve 82 and spring clutch 90 tends to increase the inside diameter of spring clutch 90. This reduces the friction between spring clutch 90 and sleeve 82 and permits shaft 86 to rotate. Any attempt to rotate shaft 86 in the reverse direction, as when ramp lever 14 is depressed, causes spring clutch 90 to tighten on the sleeve 82, thus preventing unwanted backward or retrogressive movement of the shaft 86. The function of the spring clutch 90 is similar to that of the indexing clutch 40.

The roller disc shaft 86 as illustrated in FIG. 1 includes a second end portion 94 that is rotatably supported in a journal 96 mounted to the housing side wall 74 adjacent the cover pivot point 80. A roller disc 98 is positioned on the shaft 86 intermediate the end portions 84 and 94. The roller disc 98 is nonrotatably connected to the shaft 86 by a set screw 100 threadedly positioned in a bore of the roller disc 98 and extending into engagement with a keyway 102 on the shaft 86. In this manner, the roller disc 98 rotates with the shaft 86.

With this arrangement as above described and illustrated in FIGS. 1 and 2, as the car wheel 18 depresses the ramp lever arm 14, the lever arm shaft portion 28, together with the indexing assembly 38, is rotated in a first direction without transmitting rotation to the drive adapter 52 and the drive shaft 58. After the wheel 18 has passed over and depressed the ramp lever arm 14, the torsion spring 42 returns the ramp lever arm 14 from a depressed position to its initial raised position, as illustrated in FIG. 2. During the upward movement of the ramp lever arm 14, the shaft portion 28 and indexing assembly 38 are rotated in a direction opposite to the direction of rotation associated with the downward movement of the lever arm 14.

Rotation of the indexing assembly 38 in the direction associated with the upward movement of the ramp lever arm 14 to the initial raised position is transmitted to the drive adapter 52. During this cycle of rotation of the indexing assembly 38, the clutch is drivingly connected through the drive adapter 52 to the drive shaft 58. Thus, only during the upward movement of the ramp lever arm 14 back to its initial raised position is the indexing assembly 38 drivingly engaged to the drive shaft 58. Accordingly, during the downward movement of the ramp lever arm 14, the clutch 40 is disengaged from the drive shaft 58, and therefore rotation of the clutch 40 during this movement of the ramp lever arm 14 is not transmitted to the drive shaft 58. Thus, in accordance with the present invention, rotation is not transmitted to the drive shaft 58 in response to the initial downward movement of the ramp lever arm 14. Consequently, the drive shaft 58 and the other drive components are not subjected to the shock generated by depression of the lever arm 14 by contact with the passing car wheel 18.

Torque is transmitted to the drive shaft 58 after the car wheel 18 has left the ramp lever arm 14, and occurs during the return stroke of the ramp lever arm 14 to its initial raised position. The indexing assembly 38 allows the lever arm 14 to be freely depressed and remain drivingly disconnected from the drive shaft 58 during the depression of the lever arm 14. Once the lever arm 14 has been depressed and the car wheel 18 has passed out of contact with the lever arm 14, the torsion spring 42 relatively slowly and in a uniform movement, returns the lever arm 14 to the initial raised position. This return movement is therefore free of the initial shock encountered by the contact of the car wheel 18 with the lever arm 14. Thus, by utilizing the action of the torsion spring 42 to initiate the transmission of rotation to the drive shaft 58, a cushioned, low-magnitude force is applied to the drive train from the indexing assembly 38 to the roller assembly 70.

The upward movement of the ramp lever 14 to initiate the transmission of drive to the drive shaft 58 occurs at a constant rate and remains uniform regardless of the speed of the car wheel 18 on the railway track 16. This guarantees uniform distribution of lubricant to the rail 16 upon each cycle of downward and upward movement of the lever arm 14. While the rate of the downward movement of the lever arm 14 may vary in response to the speed of the car wheel 18 on the track 16, the upward movement of the ramp lever arm 14 to its initial raised position remains constant after each depression of the lever arm 14. This arrangement overcomes the high inertial forces which are normally encountered by the resistance offered to depression of the ramp lever by the mass of the drive train. It is the resistance to the high inertial forces that cause wear and breakage of the drive components. It has also been known to contribute to overstroking and oversupply of lubricant from the lubricant pump to the track 16.

The present invention also obviates the need for a relief valve to provide a cushion to the hydraulic shock which is transmitted to the lubricator hoses and gaskets and known to result in breakage and failure of the lubricator hoses and gaskets. Because the rate at which the lever arm 14 is returned to its initial position is much slower than the rate at which it is depressed by the car wheel 18, a precise amount of lubricant is supplied to the track 16. By substantially eliminating the undesirable effects associated with the shock transmitted to the drive train, a controlled amount of lubricant is supplied to the track 16. The time for the lubricant to be supplied is increased and occurs at relatively low hydraulic pressures. Consequently, the need for a relief valve between the lubricator pump and the hoses is eliminated.

As described above, the upward movement of the ramp lever arm 14 from a depressed position to the initial raised position activates the transmission of rotation through a partial revolution from the indexing assembly 38 to the drive shaft 58 and therefrom to the roller disc shaft 86 and the roller disc 98. As illustrated in FIGS. 2 and 3, the roller disc 98 rotatably carries on the periphery thereof a plurality of rollers 104 that are operable as cam followers in a manner to be later explained in greater detail. The roller disc 98 is connected to rotate with the roller disc shaft 86. The roller disc 98 includes a plurality of sets of bores 106, 108 and 110, where the bores of each set are located at preselected radius from the geometric center of the roller disc 98 to thereby form a plurality of circles of different diameters formed by the sets of bores 106, 108 and 110.

For example, all of the bores 106 form a first diameter circle on the roller disc 98. The bores 108 form a second circle of a diameter greater than the circle formed by the bores 106. Accordingly, the third set of bores 110 form a circle having a diameter greater than the circles formed by the bores 106 and 108. The bores in each circle are separated from one another at a preselected angle. For example, all of the bores 106 are spaced 90° from one another as are the bores 108 and 110. The relationship between the bores 106 and 108 is such that each of the bores 106 is spaced at an angle of 30° from each of the adjacently positioned bores 108. Each of the bores 108 is spaced at an angle of 30° from the adjacently positioned bores 110. In this manner, the bores 106, 108 and 110 are selectively spaced from one another on the periphery of the roller disc 98.

Each of the bores 106, 108 and 110 is adapted to threadedly receive a shaft 112 of the perspective roller 104. The roller 104 is supported in a well-known manner for rotation relative to the shaft 112. Thus, with this arrangement, the rollers can be selectively positioned on the roller disc 98. In one example, as illustrated in FIG. 3, all of the rollers 104 are positioned in the bores 110 forming the largest diameter circle. In the alternative, the rollers 104 may be selectively positioned in the bores 108 or 106. Volumetric adjustments in the discharge of lubricant is also accomplished by selecting the number of rollers 104 which are mounted on the roller disc 98 and adjusting the height of the ramp lever 12 by bolts 34 and 35 shown in FIG. 2.

As the roller disc 98 rotates with the shaft 86, the rollers 104 move into and out of engagement with the surface of a cam 114 connected to one end of a rocker lever 116. The rocker lever 116 is connected, as illustrated in FIG. 3, for pivotal movement on the side wall 77 of the housing 20. With this arrangement, upon rotation of the roller disc 98, the rollers 104 being selectively positioned in the bores 106–110 of the disc 98 move into and out of contact with the cam 114. When the rollers 104 contact the cam 114, the rocker lever 116 is pivoted downwardly. It should also be understood that the roller disc 98 with rollers 104 can be replaced by a single or multiple-lobe cam for making adjustments in the volume of lubricant discharged on the track.

The pivotal connection of the lever 116 to the housing side wall 77 is accomplished by the provision of a hinge 118 that is welded to the end of the lever 116, and the hinge 118 includes a through-bore. A pair of hinge supports 120 are connected in spaced relation to the housing side wall 77 by bolts 122. The hinge supports 120 are spaced a distance apart to receive therebetween the hinge 118. Each of the hinge supports 120 also includes a through-bore aligned with the through-bore of the hinge 118. A hinge pin 124 extends through the aligned bores of the hinge 118 and the hinge supports 120. With this arrangement, the end of the of the rocker lever 116 is connected to the side wall 77 and is pivotal about the hinge pin 124.

The opposite end of the rocker lever 116 adjacent to the cam 114 supports a block 126 that is secured, such as by welding, to the top of the rocker lever 116. The block 126 includes a socket 128 aligned with a bore 130 through the end of the lever 116 for receiving the upper end of a rod 132 associated with a lubricant pump 134 partially illustrated in FIG. 3 and a lubricant pump 268 illustrated in greater detail in FIG. 4. The lubricant pumps 134 and 268 are of the type well-known in the art, as for example, illustrated in U.S. Pat. No. 3,015,376. The pump includes an outlet having a fitting connected to a hose (not shown in FIG. 1) that extends from the pump and through the housing 20 to the railway track 16. Also, as well-known in the art, the hose has an outlet positioned closely adjacent to the gauge side 24 of the track 16 to supply an incremental amount of lubricant thereto upon actuation of the pump 134.

The lubricant pump 134 shown in FIG. 3 is actuated by the downward movement of the rod 132 initiated by downward pivotal movemnet of the rocker lever 116 as the roller disc 98 rotates the rollers 104 into and out of engagement with the cam 114. As the roller disc 98 rotates and the rollers 104 engage the upper surface of the cam 114, the rocker lever 116 pivots downwardly. For each downward movement of the rocker lever 116, the rod 132 is depressed, and a preselected amount of lubricant is supplied to the gauge side 24 of the railway track 16.

The provision of the sets of bores 106, 108 and 110 on the roller disc 98 permits adjustments to be made in the amount of lubricant supplied to the track 16. For example, upon each revolution of the roller disc 98, the pump rod 132 is depressed the number of times the cam 114 is engaged by the rollers 104. Accordingly, the greater the number of rollers 104 retained on the roller disc 98, the greater the number of depressions of the rod 132 as the roller disc 98 rotates, and the greater the rate lubricant is distributed to the track 16. Thus, the pump rod 132 is depressed a preselected number of times for each revolution of the roller disc 98 and by stroke lengths proportional to the height setting of ramp lever 12.

The pump rod 132 is normally spring biased in an upward position so that upon each downward movement of the rocker lever 116 about the hinge pin 124, the spring associated with the rod 132 moves the rod 132 upwardly to return the rocker lever 116 to a normally raised position. This returns the cam 114 to a position for engagement with the rollers 104. With the above-described arrangement, the number of rollers 104 positioned on the roller disc 98 determines the rate at which lubricant is supplied to the track 16.

If the rollers 104 are positioned in the bores 106 which form the circle of the least diameter, the range of pivotal movement of the rocker lever 116 is a minimum. Consequently, the displacement of the pump rod 132 is a minimum, and the least amount of lubricant is supplied to the track 16 for the range of supply available. Accordingly, positioning the rollers 104 in the bores 108 provides for a medium output of lubricant to the track 16. Positioning the rollers 104 in the bores 110 provides for a maximum output of lubricant by the pump to the track 16. When the rollers 104 are positioned in the bores 110, the rocker lever 116 pivots through a maximum angle for initiating the maximum travel of the pump rod 132. With this arrangement, preselected amounts of lubricant are supplied to the railway track 16. The lubricant is supplied at a uniform rate free of the adverse effects of mechanical shock to the drive train and hydraulic shock to the distribution line.

Figures 4, 5:
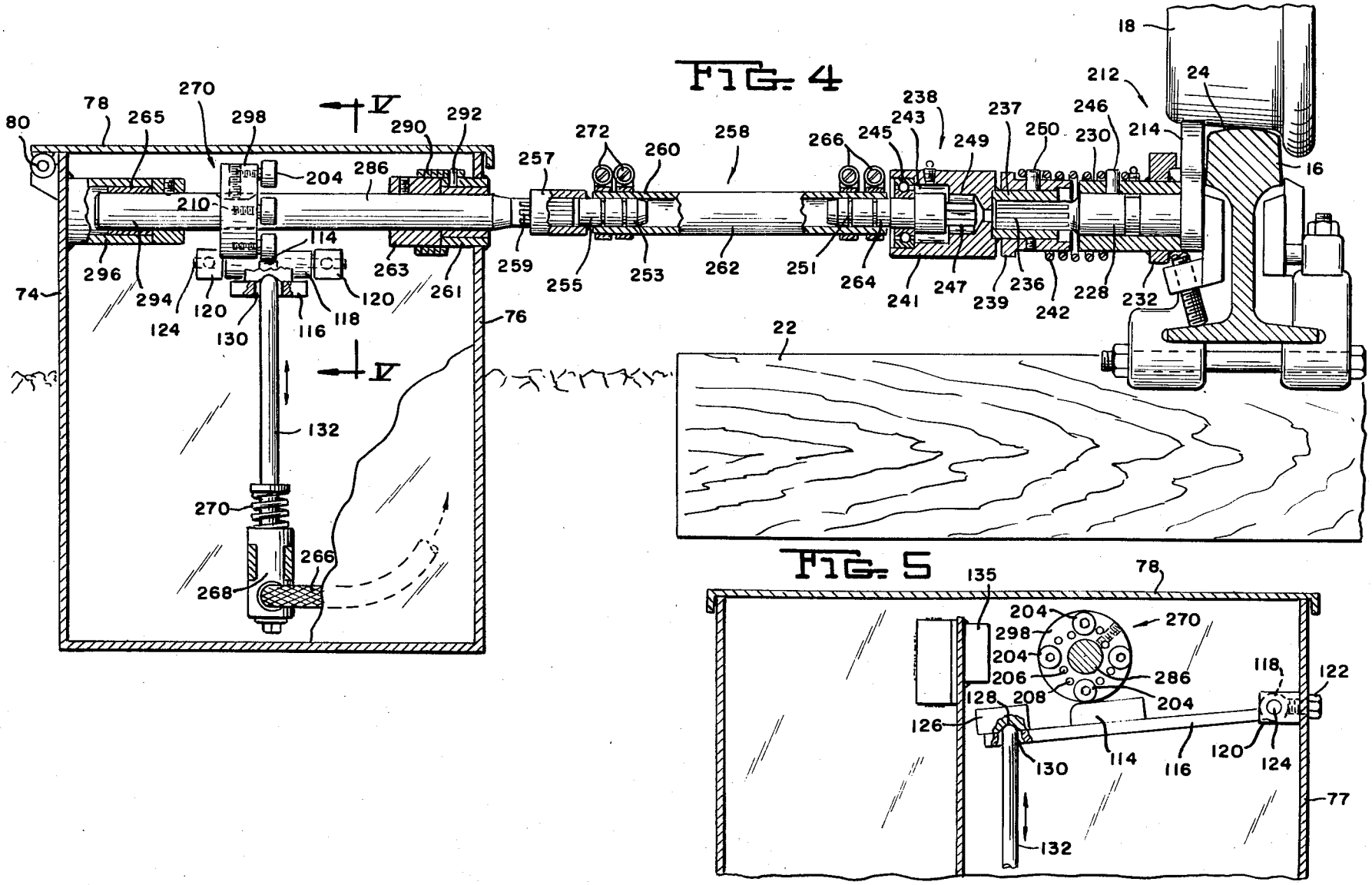
FIG. 4 is an elevational view similar to FIG. 1, illustrating a second embodiment of the railway lubricator.
FIG. 5 is a sectional view similar to FIG. 3, taken along line V—V of FIG. 4.

Referring to FIGS. 4 and 5, there is illustrated a second embodiment of the present invention in which like parts shown in FIGS. 1–3 and illustrated in FIGS. 4–5 are designated by like numerals raised by the magnitude 200. The ramp lever arm 214 of the ramp lever assembly 212 is adjustably positioned on the railway track 16 by the supporting frame 232. The shaft portion 228 of the lever arm 214 extends through the journal housing 230 of the supporting frame 232. The shaft portion 228 includes the splined portion 236. The splined portion 236 is nonrotatably connected to an internally splined sleeve 237 of the indexing assembly 238. The internally splined sleeve 237 is integrally connected, as by casting or welding (as shown in FIG. 4) to an index collar 241 to form a single unit of the indexing assembly 238. A collar 239 is positioned on and connected by a setscrew to the sleeve 237. With this arrangement, the ramp lever arm shaft portion 228 is nonrotatably connected to the index housing 241.

The torsion spring 242 extends in surrounding relation with the journal housing 230. One end of the torsion spring 242 engages the lug 246 and the opposite end of the spring 242 surrounding the collar 239 engages the lug 250. The collar 239 is rotationally adjustable on the sleeve 237 by the provision of the setscrew to allow for preloading of the torsion spring 242. Thus, as described above with regard to the operation of torsion spring 42 shown in FIG. 1, the torsion spring 242 is operable to return the ramp lever arm 214 to the initial raised position after being depressed upon contact with the car wheel 18.

The index housing 241 of the indexing assembly 238 includes an internal bore 243 for receiving one end of the index shaft 264. The index shaft 264 is supported by a bearing 245 within the housing internal bore 243. The index shaft 264 includes one end portion 247 positioned within a roller clutch 249 which is retained within the housing internal bore 243. The roller clutch 249 is positioned in the index housing 241 in surrounding relation with the index shaft end portion 247 in a manner permitting the index housing 241 to rotate freely about the index shaft 264 in one direction, for example, a clockwise direction when facing the track 16. A commercially available roller clutch suitable for use in the present invention is the Torrington roller clutch.

The index housing 241 rotates with the ramp lever arm shaft portion 228 in a clockwise direction as the lever arm 214 is depressed. The roller clutch 249 is disconnected from the index shaft 264 during this direction of rotation of the shaft portion 228. Rotation of the ramp lever arm shaft portion 228 in an opposite or counter-clockwise direction initiated by upward movement of the ramp lever arm 214 drivingly connects the roller clutch 249 to the index shaft 264.

Rotation of the ramp lever arm shaft portion 228 in the counter-clockwise direction is transmitted from the index housing 241 through the roller clutch 249 to the index shaft 264. Rotation is not transmitted to the index shaft 264 when the ramp lever arm 214 is depressed. During the return stroke of the ramp lever arm 214 from the depressed position to the initial raised position, the roller clutch 249 moves into driving engagement with the indexing shaft end portion 247. Thus rotation is transmitted to the drive shaft 258 only during the dwell period between wheel impacts. This protects the drive shaft 258 and connected components from the adverse effects of the shock loads transmitted by the car wheels 18 to the ramp lever arm 214.

The drive shaft 258 in the embodiment shown in FIG. 4, is a flexible tubular member, such as a flexible hose 262 positioned in surrounding relation with a grooved end 251 of the index shaft 264. The hose 262 is connected by the hose clamps 266 to the shaft grooved end 251. The hose clamps 266 compress the hose 262 into gripping engagement with the shaft grooved end 251. The opposite end portion 260 of the drive shaft 258 is adapted to receive a grooved end portion 253 of a drive coupling 255. The shaft end portion 260 is connected to the drive coupling 255 by the hose clamps 272. The drive coupling 255 has an opposite sleeve end portion 257 which is internally splined to drivingly receive splined end 259 of the roller disc shaft 286.

The roller disc shaft 286 is rotatably supported in a journal 261 that extends through and is connected to the housing side wall 76. A sleeve 263 is connected to the shaft 286. The wire-wrap spring clutch 290, also known as a back stop spring secured by the lug 292 to the journal 261, extends in surrounding relation from the journal 261 to the sleeve 263. The opposite end 294 of the shaft 286 is rotatably supported in a journal 296 secured to the housing side wall 74. The shaft end portion 294 is rotatably supported in the journal 296 by the provision of a bearing sleeve 265 that is press fitted into the journal 296.

As above-described in the embodiment illustrated in FIGS. 1 and 3, a roller assembly 270 including the roller disc 298 carrying the rollers 204 is rotatable with the roller disc shaft 286. The rollers 204 are shown in FIG. 5 positioned in the outer bolt circle of roller disc 298 and can be adjustably positioned in the bores 206 and 208 of the inner and middle bolt circles, respectively. With this arrangement, the radial location of the rollers 204 is adjustable on the roller disc 298 to provide a preselected supply, i.e. low, medium, or high, of lubricant at a preselected rate through the pump hose 266 to the track 16.

The embodiment of the railway lubricator illustrated in FIGS. 4 and 5 also includes the above-described pivotal rocker lever 116 connected by hinge pin 124 to the hinge supports 120 mounted on the housing side wall 77. The cam 114 is engageable with the rollers 204 on the roller disc 298, and the bar 126 on the opposite end of the rocker lever 116 is positioned on the upper end of the pump rod 132. A conventional lubricant pump 300 is illustrated in FIG. 4 and includes a return spring 302 for normally maintaining the pump rod 132 in a raised position. The lubricant pump 300 is suitably connected to a source of lubricant in a reservoir or tank, associated with the housing 20, from which lubricant is supplied to the pump 300. Upon downward movement of the pump rod 132 in response to rotation of the roller disc 298 and pivotal movement of the rocker lever 116, measured amounts of lubricant are pumped through a hose 304. The hose 304 extends from the pump 300 to a conduit (not shown) from which lubricant is dispensed on the gauge side 24 of the railway track 16. With the present invention, the time to carry out the pumping action is relatively long and the forces acting upon the pump rod 132 are relatively low. The mechanical shock normally transmitted to the drive train upon depression of the ramp lever arm 214 when contacted by the car wheels 18 is substantially eliminated. This arrangement also avoids over-travel of the pump rod 132 due to the impulse action resulting from stroking the pump as the ramp lever arm 217 is depressed by the train wheel.

According to the provisions of the patent statutes, we have explained the principle, preferred construction and mode of operation of our invention and have illustrated and described what we now consider to represent its best embodiments. However, it should be understood that, within the scope of the appended claims, the invention may be practiced otherwise than as specifically illustrated and described.

We claim:

1. A method for lubricating the rail of railway track comprising the steps of, supporting a ram lever adjacent a rail of the track for movement between a raised position and a depressed position, transmitting rotation of a shaft in a preselected direction during upward movement of the ramp lever from the depressed position to the raised position, interrupting transmission of rotation of the shaft during downward movement of the ramp lever from the raised position to the depressed position, restraining rotational movement of the shaft in a direction opposite to said preselected direction upon downward movement of the ramp lever, permitting rotational movement of the shaft in said preselected direction upon upward movement of the ramp lever, rotating a support member having a plurality of radially positioned cam rollers thereon by the rotation of the shaft, actuating a cam lever by the cam rollers upon rotational movement of the shaft to actuate a lubricant pump upon upward movement of the ramp lever to convey lubricant to the surface of the rail, and preventing actuation of the lubricant pump during downward movement of the ramp lever.

2. A lubricator for the rail of railway track comprising, a frame supported on a rail of the track, a ramp lever rotatably connected to said frame for movement between a raised position and a depressed position, a drive shaft having a first end portion and a second end portion, clutch means for drivingly connecting said drive shaft first end portion to said ramp lever to rotate said drive shaft in a preselected direction upon upward movement of said ramp lever from said depressed position to said raised position, said clutch means disengaging said drive shaft from drive connection to said ramp lever during downward movement of said ramp lever from said raised position to said depressed position, pump means for conveying lubricant to the surface of the rail, a support member connected for rotation with said shaft second end portion, a plurality of cam rollers adjustably and radially positioned relative to said drive shaft on said support member, a cam lever having a first end portion pivotally mounted adjacent to said support member and a second end portion connected to said pump means, said cam rollers being movable into and out of contact with said cam lever upon rotation of said drive shaft to initiate downward pivotal movement of said cam lever to actuate said pump means to convey lubricant to the surface of the rail upon upward movement of said ramp lever, and rotation restraining means associated with said drive shaft second end portion for exerting a biasing force upon said drive shaft to prevent rotation of said drive shaft in a direction opposite to said preselected direction upon downward movement of said ramp lever while permitting rotation of said drive shaft in said preselected direction upon upward movement of said ramp lever.

3. A lubricator as set forth in claim 2 in which, said rotation restraining means includes a spring member positioned in surrounding relation with said drive shaft second end portion, said spring member having an inner diameter frictionally engaging said drive shaft and one end portion secured to said drive shaft, said spring member being movable into increased frictional engagement with said drive shaft upon downward movement of said ramp lever to prevent rotation of said drive shaft in a direction opposite to said preselected direction of rotation of said drive shaft, and said spring member being movable out of frictional engagement with said drive shaft to the extent to permit said drive shaft to rotate in said preselected direction upward movement of said ramp lever.

4. A lubricator for the rail of railway track comprising, a frame supported on a rail of the track, a ramp lever rotatably connected to said frame for movement between a raised position and a depressed position, a flexible drive member having a first end portion and a second end portion, a rotatable clutch mounted on said flexible drive member for movement into and out of driving connection with said first end portion, said rotatable clutch being rotatable upon movement of said ramp lever, said rotatable clutch being drivingly disconnected to said flexible drive member during downward movement of said ramp lever to said depressed position, said rotatable clutch being drivingly connected to said flexible drive member during upward movement of said ramp lever to said raised position to transmit rotation in a preselected direction to said flexible drive member, anti-regression means mounted on said flexible drive member second end portion for preventing rotation of said flexible drive member in a direction opposite to said preselected direction, pump means for conveying lubricant to the surface of the rail, a support member connected for rotation with said flexible drive member second end portion, a plurality of cam rollers adjustably and radially positioned relative to said drive shaft on said flexible drive member, a cam lever having a first end portion pivotally mounted adjacent to said support member and a second end portion connected to said pump means, and said cam rollers being movable into and out of contact with said cam lever upon rotation of said flexible drive member to initiate downward pivotal movement of said cam lever to actuate said pump means to convey lubricant to the surface of the rail upon upward movement of said ramp lever.

5. A lubricator as set forth in claim 4 in which, said anti-regression means includes a clutch member positioned on said flexible drive member second end portion, said clutch member being movable into and out of frictional engagement with said flexible drive member, said clutch member being movable into frictional engagement with said flexible drive member to prevent rotation of said flexible drive member during downward movement of said ramp lever, and said clutch member frictional engagement with said flexible drive member being reduced upon upward movement of said ramp lever to the extent to permit rotation of said flexible drive member in said preselected direction.

6. A lubricator for the rails of railway track comprising, a frame supported on a rail of the track, a ramp lever having a shaft portion and a wheel striking portion extending upwardly from said shaft portion, said ramp lever movable between a raised position and a depressed position, said shaft portion rotatably connected at one end to said frame, a drive shaft having a first end portion and a second end portion, indexing means for connecting said drive shaft first end portion to the other end of said ramp lever shaft portion to transmit rotation a selected direction to said drive shaft, torsion means positioned around said ramp lever shaft portion and extending between said indexing means and said ramp lever shaft portion for returning said ramp lever to the raised position from the depressed position, means positioned on said drive shaft for preventing rotation of said drive shaft in a direction opposite to said selected direction upon downward movement of said ramp lever, said indexing means being rotatable relative to said drive shaft in a first direction upon downward movement of said ramp lever and rotatable with said drive shaft in a second direction upon upward movement of said ramp lever, said torsion means actuating upward movement of said ramp lever and transmission of rotation by said indexing means to said drive shaft, a roller assembly including a shaft nonrotatably connected to a disc, said roller assembly shaft being drivingly connected to said drive shaft, a lever pivotally mounted adjacent to said disc, pump means connected to said lever for conveying lubricant to the surface of the rail in response to movement of said lever, and follower means carried by said disc and movable into and out of engagement with said lever for actuating pivotal movement of said lever as said drive shaft rotates to supply lubricant to the surface of the rail.

7. A lubricator as set forth in claim 6 in which, said indexing means is movable into and out of driving connection with said drive shaft, said indexing means being drivingly disconnected from said drive shaft and said ramp lever during downward movement of said ramp lever, and said indexing means being drivingly connected to said drive shaft and said ramp lever during upward movement of said ramp lever to transmit torque to said drive shaft and rotate said roller assembly disc to actuate said pump means.

8. A lubricator as set forth in claim 6 in which, said torsion means includes a spring for exerting a biasing force upon said ramp lever to normally maintain said ramp lever in a raised position, said spring having opposite end portions secured to said ramp lever shaft portion and said indexing means, and said spring being operable to rotate said ramp lever shaft portion to raise said ramp lever and rotate said idexing means in said second direction to actuate said pump means during the interval said ramp lever moves from said depressed position to said raised position.

9. A lubricator as set forth in claim 6 in which, said ramp lever wheel striking portion is contacted by the wheel of a car passing on the track, said ramp lever being depressed during the interval said wheel striking portion is in contact with the wheel, said indexing means being drivingly disconnected from said drive shaft during the interval said ramp lever is depressed, said ramp lever being raised by said torsion spring during the interval said wheel striking portion is out of contact with the wheel, and said indexing means being drivingly connected to said drive shaft during the interval said ramp lever is raised.

10. A lubricator as set forth in claim 6 in which, said drive shaft is rotated upon actuation of said torsion spring to return said ramp lever from said depressed position to said raised position.

11. A lubricator as set forth in claim 6 in which, said indexing means is drivingly disconnected from said drive shaft during the interval of movement of said ramp lever from said raised position to said lowered position.

12. A lubricator as set forth in claim 6 in which, said indexing means is drivingly connected to said drive shaft during the interval of movement of said ramp lever from said lowered position to said raised position.

13. A lubricator as set forth in claim 6 in which, said indexing means includes a rotatable clutch movable into and out of driving connection with said drive shaft first end portion, said rotatable clutch being rotatable with said ramp lever shaft portion, said rotatable clutch being drivingly disconnected from said drive shaft first end portion during rotation of said ramp lever shaft portion in said first direction, and said rotatable clutch being drivingly connected to said drive shaft first end portion during rotation of said ramp lever shaft portion in said second direction.

14. A lubricator as set forth in claim 6 in which, said drive shaft includes a flexible member having adaptor means for connecting one end of said flexible member to said indexing means and an opposite end to said roller assembly shaft.

15. A lubricator as set forth in claim 6 in which, said follower means include a plurality of rollers adjustably radially positioned on said disc relative to said roller assembly shaft, and said rollers being selectively spaced from one another to move into and out of engagement with said lever upon rotation of said roller assembly shaft to pivot said lever at preselected intervals to control the amount and rate of lubricant supplied to the surface of the rail.

16. A lubricator as set forth in claim 6 in which, said lever includes a cam surface positioned adjacent said follower means, said follower means being movable into and out of contact with said cam surface and initiate downward pivotal movement of said lever, and said pump means including a rod abutting said lever and movable upon said downward pivotal movement of said lever to actuate said pump means to supply lubricant to the surface of the rail.

* * * * *